US007113734B2

(12) United States Patent
Deguchi et al.

(10) Patent No.: US 7,113,734 B2
(45) Date of Patent: Sep. 26, 2006

(54) PROCESS CARTRIDGE HAVING A GUIDE MEMBER WITH A FLEXIBLE PORTION

(75) Inventors: Hideaki Deguchi, Nagoya (JP); Takeshi Takami, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 9 days.

(21) Appl. No.: 10/949,405

(22) Filed: Sep. 27, 2004

(65) Prior Publication Data

US 2005/0069343 A1 Mar. 31, 2005

(30) Foreign Application Priority Data

Sep. 29, 2003 (JP) ..... 2003-336996
Mar. 31, 2004 (JP) ..... 2004-107319

(51) Int. Cl.
*G03G 15/16* (2006.01)

(52) U.S. Cl. ..... 399/316; 399/111; 399/388

(58) Field of Classification Search ..... 399/111, 399/268, 313, 316, 388
See application file for complete search history.

(56) References Cited

U.S. PATENT DOCUMENTS 4,882,606 A * 11/1989 Deguchi ..... 399/316
5,321,477 A 6/1994 Nagata et al.
5,337,128 A 8/1994 Hashizume et al.
5,424,818 A * 6/1995 Yoshimura et al. ..... 399/313
5,749,035 A * 5/1998 Ban et al. ..... 399/316
5,799,384 A * 9/1998 Schwartz et al. ..... 29/458
6,457,863 B1 * 10/2002 Vassallo ..... 383/43
6,512,904 B1 1/2003 Sato et al.
2001/0033760 A1 * 10/2001 Sawanaka et al. ..... 399/316

FOREIGN PATENT DOCUMENTS

JP A-5-257395 10/1993
JP B2-2961472 8/1999
JP A-11-338279 12/1999
JP B2-3019511 1/2000
JP B2-3026287 1/2000
JP B2-3050943 3/2000
JP A-2000-214695 8/2000
JP A-2001-341890 12/2001

* cited by examiner

*Primary Examiner*—Susan Lee
(74) *Attorney, Agent, or Firm*—Oliff & Berridge, PLC

(57) ABSTRACT

A step portion is formed on a lower casing of a process cartridge, and a film member composed of flexible resin film is fixed to a step portion such that a front portion can bend. The film member guides a sheet to a photosensitive drum. In this manner, a thin sheet which lacks firmness is adhered on an upstream side of a transfer position in a rotational direction of the photosensitive drum, thus preventing electrical discharges, while a thick sheet which has firmness is bent by the front portion of the film member in a direction in which a leading edge of the sheet is headed, thus guiding the sheet such that operating abnormalities are prevented and an appearance of ghosts is prevented.

44 Claims, 9 Drawing Sheets

PROCESS CARTRIDGE HAVING A GUIDE MEMBER WITH A FLEXIBLE PORTION

BACKGROUND OF THE INVENTION

1. Field of the Invention

The present invention relates to an image forming device, and more particularly to a process cartridge provided in the image forming device.

2. Description of Related Art

Generally, an image forming device such as a laser printer is detachably provided with a process unit having a photosensitive drum on which toner images are borne by developing electrostatic latent images.

The photosensitive drum is disposed in confrontation with and in contact with a transfer roller such that, when a sheet of paper passes between the photosensitive drum and the transfer roller, an image is formed on the paper by transferring the toner image onto the paper.

For example, Japanese patent-application publication (kokai) No. HEI-11-338279 proposes to dispose a transfer nip forming member in proximity to the transfer nip position in low-moisture conditions, while placing the transfer nip formation member separated from and even farther upstream than the transfer nip in high-moisture conditions, electrical discharges and toner scattering would be prevented in high-moisture conditions, and transfer efficiency would be improved.

SUMMARY OF THE INVENTION

However, in order to place the transfer nip formation member in proximity to or separated from the transfer nip position, a drive mechanism such as a motor or cam, as well as a control mechanism for controlling the drive mechanism, become necessary, which makes the structure of the device more complex and results in an increase in cost.

In view of the above-described drawbacks, it is an objective of the present invention to provide a process cartridge and an image forming device provided with the process cartridge, which can perform a reliable transfer at low cost and with a simple structure.

In order to attain the above and other objects, the present invention provides a process cartridge detachably mounted on an image forming device. The process cartridge includes an image bearing member and a guide member. The image bearing member has a surface on which a developer image is borne. The guide member is disposed upstream of the image bearing member in a conveying direction of a transfer medium, thereby guiding the transfer medium toward the image bearing member. The guide member includes a front portion positioned adjacent to the image bearing member and being flexible, and a rear portion positioned upstream of the front portion in the conveying direction and being fixed at a position.

The present invention also provides an image forming device. The image forming device includes a main casing, a process cartridge, and a fixing unit. The process cartridge is detachably mounted on the main casing. The process cartridge includes an image bearing member and a guide member. The image bearing member has a surface on which a developer image is borne. The guide member is disposed upstream of the image bearing member in a conveying direction of a transfer medium, thereby guiding the transfer medium toward the image bearing member. The guide member has a front portion positioned adjacent to the image bearing member and being flexible, and a rear portion positioned upstream of the front portion in the conveying direction and being fixed at a position. The fixing unit fixes the developer image which has been transferred from the image bearing member to the transfer medium in the process cartridge.

The present invention also provides an image forming device. The image forming device includes an image bearing member and a guide member. The image bearing member has a surface on which a developer image is borne. The guide member is disposed upstream of the image bearing member in a conveying direction of a transfer medium, thereby guiding the transfer medium toward the image bearing member. The guide member includes a front portion positioned adjacent to the image bearing member and being flexible, and a rear portion positioned upstream of the front portion in the conveying direction and being fixed at a position.

BRIEF DESCRIPTION OF THE DRAWINGS

The above and other objects, features and advantages of the invention will become more apparent from reading the following description of the preferred embodiments taken in connection with the accompanying drawings in which:

FIG. 3(*b*) is an explanatory diagram for explaining characteristics of a film member such as flexural rigidity EI;

FIG. 4(*b*) is a plan view of a film member disposed at the lower casing shown in FIG. 3(*a*), where the film member is divided into segments in the widthwise direction;

FIG. 4(*c*) is an explanatory diagram showing a contact angle formed between a sheet and a tangent line extending from a contact position toward an upstream direction in the rotational direction;

FIG. 9(*b*) is a plan view showing a film member formed with tear prevention portions on the cut lines;

FIG. 10(*b*) is a plan view showing a film member formed with elongated cutouts having substantially V-shapes;

FIG. 10(*c*) is a plan view showing a film member formed with elongated cutouts having substantially U-shapes;

FIG. 10(*d*) is a plan view showing a film member formed with elongated cutouts having substantially V-shapes with tear prevention portions;

DETAILED DESCRIPTION OF THE PREFERRED EMBODIMENTS

A process cartridge and an image forming device according to a preferred embodiment of the present invention will be described while referring to the accompanying drawings.

Figure 1:
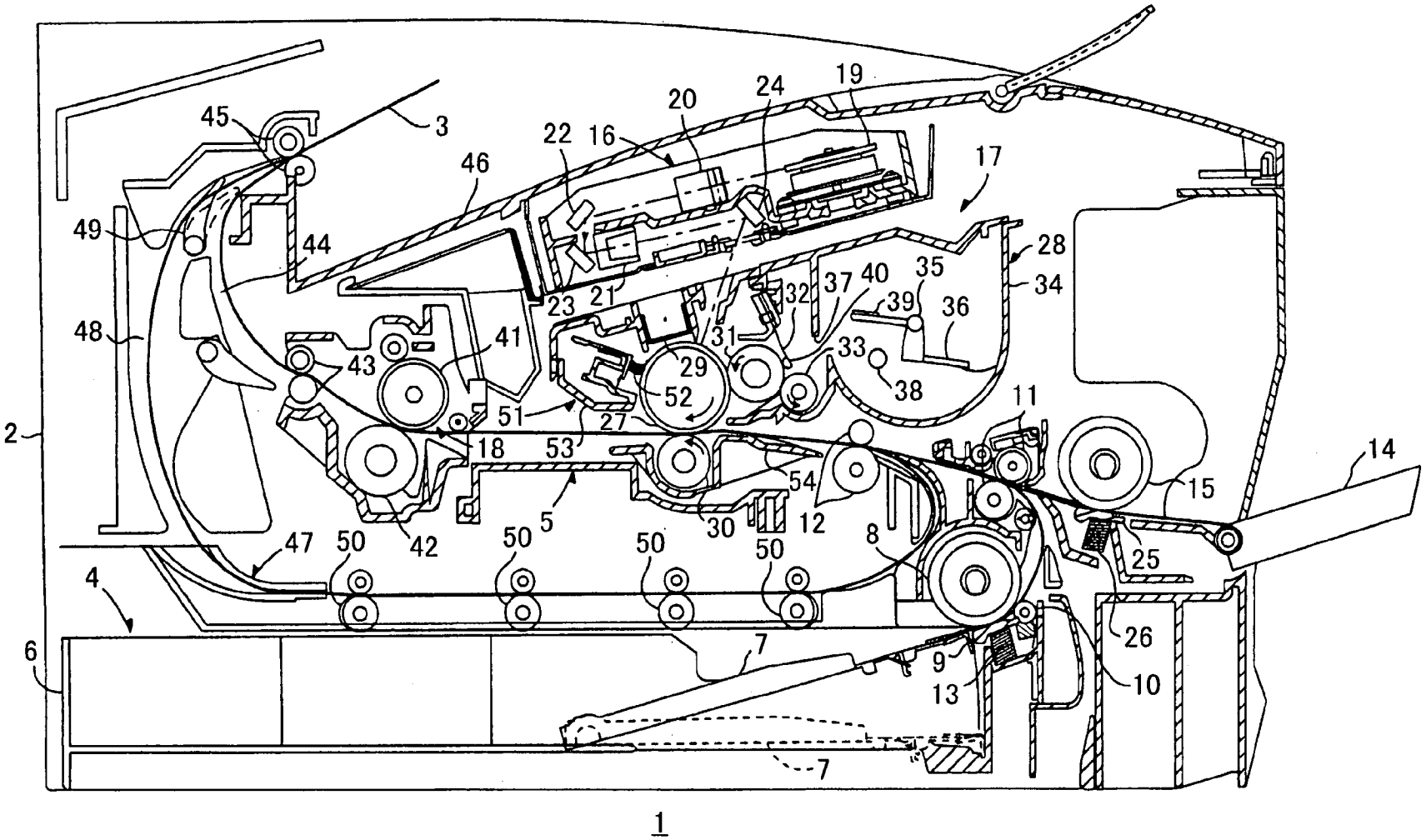
FIG. 1 is a side cross-sectional view showing a laser printer according to an embodiment of the present invention.

A laser printer according to an embodiment of the present invention will be described with reference to FIG. 1. As shown in FIG. 1, the laser printer 1 includes a main casing 2, a feeder unit 4, and an image forming unit 5. The feeder unit 4 and the image forming unit 5 are housed in the main casing 2. The feeder unit 4 supplies sheets 3 to the image forming unit 5. The image forming unit 5 forms desired images on the supplied sheets 3.

The feeder unit 4 is located within the lower section of the main casing 2 and includes a sheet supply tray 6, a sheet pressing plate 7, a sheet supply roller 8, a sheet supply pad 9, paper dust removing rollers 10, 11, and a pair of registration rollers 12. The sheet supply tray 6 is detachably mounted with respect to the main casing 2. The sheet pressing plate 7 is pivotally movably provided within the sheet supply tray 6. The sheet supply roller 8 and the sheet supply pad 9 are provided above one end of the sheet supply tray 6. The paper dust removing rollers 10, 11 are disposed downstream from the sheet supply roller 8 with respect to the direction in which the sheets 3 are transported. The registration rollers 12 are provided downstream from the paper dust removing rollers 10, 11 in the sheet transport direction of the sheets 3.

The sheet pressing plate 7 is capable of supporting a stack of sheets 3. The sheet pressing plate 7 is pivotably supported at its end furthest from the supply roller 8 so that the end of the sheet pressing plate 7 that is nearest the supply roller 8 can move vertically. Although not shown in the drawings, a spring for urging the sheet pressing plate 7 upward is provided to the rear surface of the sheet pressing plate 7. Therefore, the sheet pressing plate 7 pivots downward in accordance with increase in the amount of sheets 3 stacked on the sheet pressing plate 7. At this time, the sheet pressing plate 7 pivots around the end of the sheet pressing plate 7 farthest from the sheet supply roller 8, downward against the urging force of the spring. The sheet supply roller 8 and the sheet supply pad 9 are disposed in confrontation with each other. A spring 13 is provided beneath the sheet supply pad 9 for pressing the sheet supply pad 9 toward the sheet supply roller 8.

Urging force of the spring under the sheet pressing plate 7 presses the uppermost sheet 3 on the sheet pressing plate 7 toward the supply roller 8 so that rotation of the supply roller 8 moves the uppermost sheet 3 between the supply roller 8 and the separation pad 13. In this way, one sheet 3 at a time is separated from the stack and supplied to the paper dust removing rollers 10, 11.

The paper dust removing rollers 10, 11 remove paper dust from the supplied sheets 3 and further convey the same to the registration rollers 12. The pair of registration rollers 12 performs a desired registration operation on the supplied sheets 3. Then the sheets 3 are transported to an image formation position. In the image formation position a photosensitive drum 27 and a transfer roller 30 contact each other. In other words, the image formation position is a transfer position TP where the visible toner image is transferred from the surface of the photosensitive drum 27 to a sheet 3 as the sheet 3 passes between the photosensitive drum 27 and the transfer roller 30.

The feeder unit 4 further includes a multipurpose tray 14, a multipurpose sheet supply roller 15, and a multipurpose sheet supply pad 25. The multipurpose sheet supply roller 15 and the multipurpose sheet supply pad 25 are disposed in confrontation with each other and are for supplying sheets 3 that are stacked on the multipurpose tray 14. A spring 26 provided beneath the multipurpose sheet supply pad 25 presses the multipurpose sheet supply pad 25 up toward the multipurpose sheet supply roller 15.

Rotation of the multipurpose sheet supply roller 15 moves sheets 3 one at a time from the stack on the multipurpose tray 14 to a position between the multipurpose sheet supply pad 25 and the multipurpose sheet supply roller 15 so that the sheets 3 on the multipurpose tray 14 can be supplied one at a time to the image formation position.

The image forming section 5 includes a scanner section 16, a process cartridge 17, and a fixing section 18. The scanner section 16 is provided at the upper section of the casing 2 and is provided with a laser emitting section (not shown), a rotatingly driven polygon mirror 19, lenses 20, 21, and reflection mirrors 22, 23, 24. The laser emitting section emits a laser beam based on desired image data. As indicated by single-dot chain line in FIG. 1, the laser beam passes through or is reflected by the mirror 19, the lens 20, the reflection mirrors 22 and 23, the lens 21, and the reflection mirror 24 in this order so as to irradiate, in a high speed scanning operation, the surface of the photosensitive drum 27 of the process cartridge 17.

The process cartridge 17 is disposed below the scanner section 16. The process cartridge 17 includes a casing 51 and a development cartridge 28. The casing 51 is detachably mounted on the main casing 2 and houses the photosensitive drum 27, a scorotron charge unit 29, a transfer roller 30, and a conductive brush 52. In other words, the process cartridge 17 is detachably mounted on the laser printer 1.

The casing 51 straddles a transport path of the sheet 3, and includes an upper casing 53 and a lower casing 54. The upper casing 53 houses the photosensitive drum 27, the scorotron charge unit 29, and the conductive brush 52. The developing cartridge 28 is detachably attached to the upper casing 53. The lower casing 54 houses the transfer roller 30.

The development cartridge 28 is detachable from the casing 51 and provided with a developing roller 31, a layer thickness regulating blade 32, a supply roller 33 and a toner hopper 34.

The toner hopper 34 is filled with positively charging, non-magnetic, single-component toner. In the present embodiment, polymerization toner is used as the toner. Polymerization toner has substantially spherical particles and so has an excellent fluidity characteristic. To produce polymerization toner, a polymerizing monomer is subjected to well-known copolymerizing processes, such as suspension polymerization. Examples of a polymerizing monomer include a styrene type monomer or an acrylic type monomer. An example of a styrene type monomer is styrene. Examples of acrylic type monomers are acrylic acid, alkyl (C1–C4) acrylate, and alkyl (C1–C4) metacrylate. Because the polymerization toner has such an excellent fluidity characteristic, image development is reliably performed so that high-quality images can be formed.

Materials such as wax and a coloring agent are distributed in the toner. The coloring agent can be carbon black, for example. In addition, external additive, such as silica, are added in the toner to further improve the fluidity characteristic. The toner has a particle diameter of about 6–10 μm.

The rotation shaft 35 is disposed in the center of the toner hopper 34. An agitator 36 and a cleaner 39 are supported on the rotation shaft 35. The agitator 36 agitates the toner in the toner hopper 34 and discharges the toner through the toner supply opening 37 that is opened through the side wall of the toner hopper 34. Windows 38 are formed in the end walls that define the lengthwise ends of the toner hopper 34. The windows 38 are used to detect the amount of toner remaining in the toner hopper 34. The cleaner 39 cleans the windows 38 as the agitator 36 rotates.

The supply roller 33 is located on the side of the toner supply opening 37. The developing roller 31 is located confronting the supply roller 33. The supply roller 33 and the developing roller 31 are rotatable in the counterclockwise direction. The supply roller 33 and the developing roller 31 are disposed in abutment contact with each other so that both are compressed to a certain extent.

The supply roller 33 includes a metal roller shaft covered with a roller formed from an electrically conductive sponge material.

The developer roller 31 includes a metal roller shaft and a roller portion covered thereon. The roller portion is made from a resilient member formed from a conductive rubber material. In more specific terms, the roller portion of the developing roller 31 is made from conductive silicone rubber or urethane rubber including, for example, carbon particles. The surface of the roller portion is covered with a coating layer of silicone rubber or urethane rubber that contains fluorine. The developing roller 31 is applied with a developing bias.

The layer thickness regulating blade 32 is disposed near the developing roller 31. The layer thickness regulating blade 32 includes a blade made from a metal leaf spring, and has a pressing member 40, that is provided on a free end of the blade. The pressing member 40 has a semi-circular shape when viewed in cross section. The pressing member 40 is formed from silicone rubber with electrically insulating properties. The layer thickness regulating blade 32 is supported by the developing cartridge 28 at a location near the developing roller 31. The resilient force of the blade presses the pressing member 40 against the surface of the developing roller 31.

Then rotation of the supply roller 33 supplies the developing roller 31 with the toner that has been discharged through the toner supply opening 37. At this time, the toner is triboelectrically charged to a positive charge between the supply roller 33 and the developing roller 31. Then, as the developing roller 31 rotates, the toner supplied onto the developing roller 31 moves between the developing roller 31 and the pressing member 40 of the layer thickness regulating blade 32. This reduces thickness of the toner on the surface of the developing roller 31 down to a thin layer of uniform thickness.

The photosensitive drum 27 is disposed to the side of and in confrontation with the developing roller 31. The photosensitive drum 27 is supported on the upper casing 53 and is rotatable in the clockwise direction (direction shown by the arrow). The photosensitive drum 27 includes a drum-shaped member and a surface layer. The drum-shaped member is connected to ground. The surface layer is formed on the drum-shaped member from a photosensitive layer that is made from polycarbonate and that has a positively charging nature.

The scorotoron charge unit 29 is also supported on the upper casing 53. The scorotoron charge unit 29 is disposed above the photosensitive drum 27 and is spaced away from the photosensitive drum 27 by a predetermined space so as to avoid direct contact with the photosensitive drum 27. The scorotron charge unit 29 is a positive-charge scorotron type charge unit for generating a corona discharge from a charge wire made from, for example, tungsten, to form a blanket of positive-polarity charge on the surface of the photosensitive drum 27.

The conductive brush 52 is disposed in confrontation with the photosensitive drum 27, on the side of the photosensitive drum 27 (on the opposite side from the developing roller 31). The conductive brush 52 is fixed to the upper casing 53 such that a tip of the brush comes into contact with the surface of the photosensitive drum 27.

The transfer roller 30 is rotatably supported in the casing 51 at a position below and in confrontation with the photosensitive drum 27. The transfer roller 30 is supported on the lower casing 54 rotatably in the direction shown by the arrow (the counterclockwise direction). The transfer roller 30 is an ion-conductive type of transfer roller. The transfer roller 30 includes a metal roller shaft and a roller portion covering the shaft and made from electrically-conductive rubber material. At times of toner image transfer, the transfer roller 30 is applied with a transfer bias via constant current control.

The scorotoron charge unit 29 forms a blanket of positive charge on the surface of the photosensitive drum 27 as the photosensitive drum 27 rotates. Then, the surface of the photosensitive drum 27 is exposed to high speed scan of the laser beam from the scanner section 16. The electric potential of the positively charged surface of the photosensitive drum 27 drops at positions exposed to the laser beam. As a result, an electrostatic latent image is formed on the photosensitive drum 27 based on desired image data used to drive the laser beam. Next, an inverse developing process is performed. That is, as the developing roller 31 rotates, the positively-charged toner borne on the surface of the developing roller 31 is brought into contact with the photosensitive drum 27. At this time, the toner on the developing roller 31 is supplied to lower-potential areas of the electrostatic latent image on the photosensitive drum 27. As a result, the toner is selectively borne on the photosensitive drum 27 so that the electrostatic latent image is developed into a visible toner image.

Thereafter, the visible toner image borne on the surface of the photosensitive drum 27 is transferred to a sheet 3 according to the transfer bias applied to the transfer roller 30 as the sheet 3 passes between the photosensitive drum 27 and the transfer roller 30.

After that, the photosensitive drum 27 and the transfer roller 30 are rotatably driven such that the sheet 3 is pinched and conveyed between the two. The developer image which is borne on the surface of the photosensitive drum 27 is transferred onto the sheet 3, as the sheet 3 is conveyed between the photosensitive drum 27 and the transfer roller 30. In this way, the developer image borne on the surface of the photosensitive drum 27 is transferred while the sheet 3 is conveyed between the photosensitive drum 27 and the transfer roller 30. At this time, a film member 60 to be described later feeds the sheet 3 toward the photosensitive drum 27 and the transfer roller 30 in accordance with the characteristics of the sheet 3. Therefore, highly precise transfers can be achieved.

Following transfer, when the surface of the photosensitive drum 27 comes into opposition with the brush on the conductive brush 52 by the rotation of the photosensitive drum 27, paper particles which adhered to the surface of the photosensitive drum 27 due to contact with the sheet 3 are removed by the brush.

The fixing section 18 is disposed downstream from the process cartridge 17 and includes a heat roller 41, a pressing roller 42, and transport rollers 43. The pressing roller 42 presses against the heat roller 41. The transport rollers 43 are provided downstream from the heat roller 41 and the pressing roller 42. The heat roller 41 includes a metal tube and a halogen lamp disposed therein. The halogen lamp heats up the metal tube so that toner that has been transferred onto sheet 3 in the process cartridge 17 is thermally fixed onto the sheet 3 as the sheet 3 passes between the heat roller 41 and the pressing roller 42. Afterward, the sheet 3 is transported to a sheet-discharge path 44 by the transport rollers 43 and discharged onto a sheet-discharge tray 46 by sheet-discharge rollers 45.

In the laser printer 1, residual toner which is left on the surface of the photosensitive drum 27 after a transfer to the sheet 3 is recovered by the developing roller 31. That is, the residual toner is recovered using a so-called cleanerless method. By recovering the residual toner using the cleanerless method, a toner cleaning device and a used-toner reservoir become unnecessary, which simplifies the construction of the device.

The laser printer 1 is further provided with an inverting transport unit 47 for inverting sheets 3 that have been printed on once and for returning the sheets 3 to the image forming unit 5 so that images can be formed on both sides of the sheets 3. The inverting transport unit 47 includes the sheet-discharge rollers 45, an inversion transport path 48, a flapper 49, and a plurality of inversion transport rollers 50.

The sheet-discharge rollers 45 are a pair of rollers that can be rotated selectively forward or in reverse. The sheet-discharge rollers 45 are rotated forward to discharge sheets 3 onto the sheet-discharge tray 46 and rotated in reverse when sheets are to be inverted.

The inversion transport rollers 50 are disposed below the image forming unit 5. The inversion transport path 48 extends vertically between the sheet-discharge rollers 45 and the inversion transport rollers 50. The upstream end of the inversion transport path 48 is located near the sheet-discharge rollers 45 and the downstream end is located near the inversion transport rollers 50 so that sheets 3 can be transported downward from the sheet-discharge rollers 45 to the inversion transport rollers 50.

The flapper 49 is swingably disposed at the junction between the sheet-discharge path 44 and the inversion transport path 48. By activating or deactivating a solenoid (not shown), the flapper 49 can be selectively swung between the orientation shown in broken line and the orientation shown by solid line in FIG. 1. The orientation shown in solid line in FIG. 1 is for transporting sheets 3 that have one side printed to the sheet-discharge rollers 45. The orientation shown in broken line in FIG. 1 is for transporting sheets from the sheet-discharge rollers 45 into the inversion transport path 48, rather than back into the sheet-discharge path 44.

The inversion transport rollers 50 are aligned horizontally at positions above the sheet supply tray 6. The pair of inversion transport rollers 50 that is farthest upstream is disposed near the rear end of the inversion transport path 48. The pair of inversion transport rollers 50 that is located farthest downstream is disposed below the registration rollers 12.

The inverting transport unit 47 operates in the following manner when a sheet 3 is to be formed with images on both sides. A sheet 3 that has been formed on one side with an image is transported by the transport rollers 43 from the sheet-discharge path 44 to the sheet-discharge rollers 45. The sheet-discharge rollers 45 rotate forward with the sheet 3 pinched therebetween until almost all of the sheet 3 is transported out from the laser printer 1 and over the sheet-discharge tray 46. The forward rotation of the sheet-discharge rollers 45 is stopped once the rear-side end of the sheet 3 is located between the sheet-discharge rollers 45. Then, the sheet-discharge rollers 45 are driven to rotate in reverse while at the same time the flapper 49 is switched to change transport direction of the sheet 3 toward the inversion transport path 48. As a result, the sheet 3 is transported into the inversion transport path 48. The flapper 49 reverts to its initial position once transport of the sheet 3 to the inversion transport path 48 is completed. That is, the flapper 49 switches back to the position for transporting sheets from the transport rollers 43 to the sheet-discharge rollers 45.

Next, the inverted sheet 3 is transported through the inversion transport path 48 to the inversion transport rollers 50 and then upward from the inversion transport rollers 50 to the registration rollers 12. The registration rollers 12 align the front edge of the sheet 3. Afterward, the sheet 3 is transported toward the image formation position. At this time, the upper and lower surfaces of the sheet 3 are reversed from the first time that an image has been formed on the sheet 3 so that an image can be formed on the other side as well. In this way, images are formed on both sides of the sheet 3.

Figure 2:
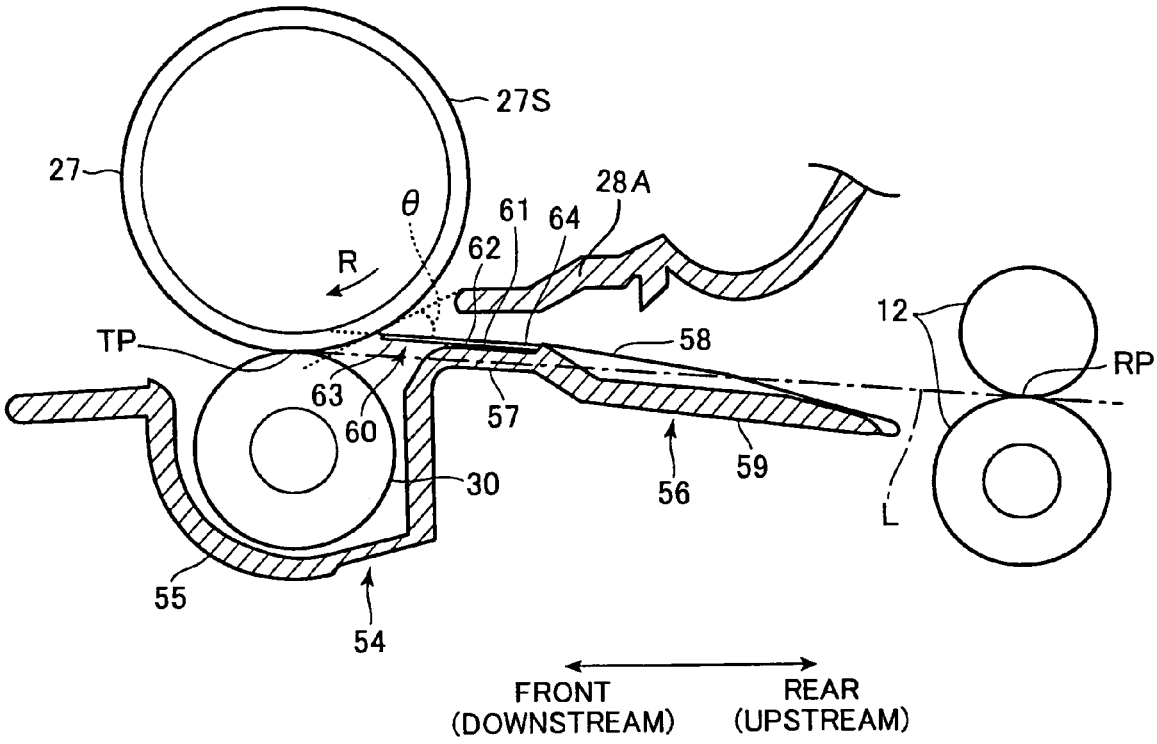
FIG. 2 is a side cross-sectional view showing part of a process cartridge in the laser printer of FIG. 1.

As shown in FIG. 2, in the laser printer 1, the lower casing 54 of the process cartridge 17 includes a transfer-roller receiving portion 55 and a sheet guide portion 56 in a continuous and integrated manner. The transfer-roller receiving portion 55 houses the transfer roller 30. The sheet guide portion 56 is disposed upstream of the transfer-roller receiving portion 55 and guides the sheet 3 toward the photosensitive drum 27. The sheet guide member 56 is also disposed in confrontation with a confronting member portion 28A of the developing cartridge 28 casing such that the confronting member 28A does not contact a transfer medium that may be conveyed toward the photosensitive drum 27.

The transfer-roller receiving portion 55 is formed into a concave shape in cross section along a widthwise direction perpendicular to a conveying direction of the sheet 3 (hereinafter referred to simply as widthwise direction). The transfer roller 30 is housed in the transfer-roller receiving portion 55, and is supported rotatably within the transfer-roller receiving portion 55 in a position beneath the photosensitive drum 27. The transfer-roller receiving portion 55 is in confrontation with and in contact with the photosensitive drum 27.

The sheet guide portion 56 constitutes part of the lower casing 54. The sheet guide portion 56 has a substantially planar shape which inclines slightly from a rear end (the end which is upstream of the conveying direction of the sheet 3, likewise hereinafter) toward a front end (the end which is downstream of the conveying direction, likewise hereinafter). The sheet guide portion 56 is provided, in a continuous and integrated manner, with a holding member 57 and an introducing portion 59 on which rib members 58 are provided.

The holding member 57 is fixed at the transfer-roller receiving portion 55. The holding member 57 is formed such that its front end continues into the rear end of the transfer-roller receiving portion 55, and its rear end continues into the front end of the introducing portion 59. A step portion 61 is formed on the holding member 57 for holding the film member 60 described below.

Figure 3A:
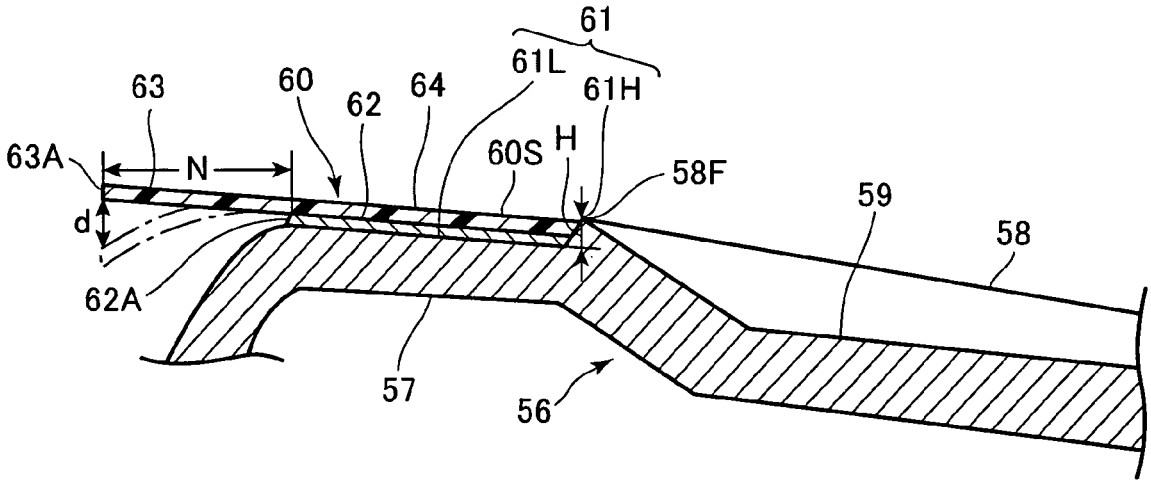
FIG. 3(*a*) is an enlarged side cross-sectional view of a lower casing of the process cartridge shown in FIG. 2.
Figure 3B:
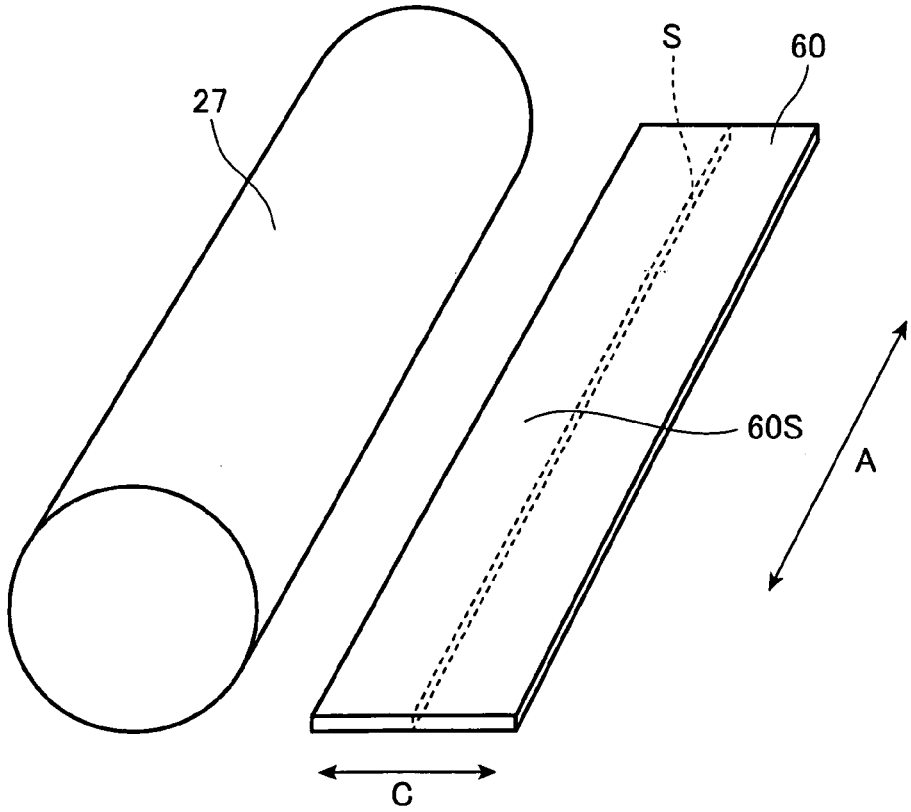

As shown in FIG. 3(*a*), the step portion 61 is formed as a step having substantially an L-shape in cross section which dips downward. The step portion 61 includes a higher portion 61H and a lower portion 61L positioned at a height lower than the higher portion 61H. A height difference H is a difference in height between the higher portion 61H and the lower portion 61L. The height difference H is set such that, when the rear portion 64 of the film member 60 is held at the lower portion 61L of the step portion 61, a top surface 60S of the film member 60 is positioned at the same height as or below the higher portion 61H. In other words, the top surface 60S is positioned at a height that is equal to or lower than the height of the higher portion 61H.

As shown in FIG. 2, the introducing portion 59 is formed such that its front end is continuous with the holding member 57, and its rear end extends toward the vicinity of a pair of registration rollers 12.

The rib members 58 are disposed at the introducing portion 59. The rib members 58 are formed to provide reinforcement and to reduce frictional resistance during paper feeding. The rib members 58 are plate-shaped, extend in the conveying direction on a top surface of the introducing portion 59. The rib members 58 are separated from one another by a predetermined interval in the widthwise direction. In addition, a front end (downstream end) 58F of each of the rib members 58 is positioned at a height substantially equal to the height of the rear end of the step portion 61, that is, the height of the higher portion 61H.

In the process cartridge 17, the film member 60 is supported at the step portion 61 on the holding member 57. The film member 60 is formed of an insulating material, for example a resin such as polyethylene telephthalate. The film member 60 is formed as a substantially rectangular film with a thickness of 80 to 200 μm by pressing process or stamping process. As shown in FIG. 3(*b*), the photosensitive drum 27 extends in its lengthwise direction or axial direction A. The film member 60 has the top surface 60S, that is, its widest surface 60S on which the sheet 3 is conveyed. The film member 60 has a product (flexural rigidity) EI satisfying a range $3.49\times10^{-5} \leqq EI \leqq 1.18\times10^{-3}$, where E is Young's modulus in a direction C parallel to the conveying direction, and I is a geometric moment of inertia with respect to a cross section S that extends parallel to the axial direction A and perpendicular to the widest surface 60S of the film member 60.

With the film member 60, its rear portion 64 is affixed to the upper surface of the step portion 61 using double-sided tape 62 such that its front portion 63 bends in the vicinity of the photosensitive drum 27. Consequently, it is necessary to consider not only the thickness of the film member 60, but the thickness of the double-sided tape as well, and to set the height difference H of the step portion 61.

The film member 60 is formed into a predetermined shape by cutting by pressing process and has a front surface and a back surface opposite to the front surface. The front surface is defined as a surface that comes into contact with a cutting blade first during the pressing process. The front surface is called shear-drooped side. In this affixed state, the film member 60 is disposed such that the front surface faces upward and contacts the sheet 3 when the sheet 3 is conveyed on the film member 60, and that the back surface confronts the step portion 61.

As shown in FIG. 3(*a*), the front portion 63 of the film member 60 is bendable or flexible, since the front portion 63 does not confront the upper surface (lower portion) 61L of the step portion 61 and is not fixed. The front portion 63 has a length N in the conveying direction that is greater than or equal to 1 mm. The front portion 63 has a front edge 63A that is spaced from the photosensitive drum 27. In other words, the front edge 63A does not make contact with the photosensitive drum 27.

In addition, as shown in FIG. 2, the pair of registration rollers 12 is disposed upstream from the sheet guide portion 56 in the conveying direction and in contact with each other at a registration position RP. The photosensitive drum 27 and the transfer roller 30 are in contact with each other at a transfer position TP. The front edge 63A of the front portion 63 is positioned on a side where the photosensitive drum 27 is located with regard to a line segment L connecting the registration position RP and the transfer position TP. That is, the front edge 63A is positioned above the line segment L connecting the registration position RP and the transfer position TP.

Figure 4A:
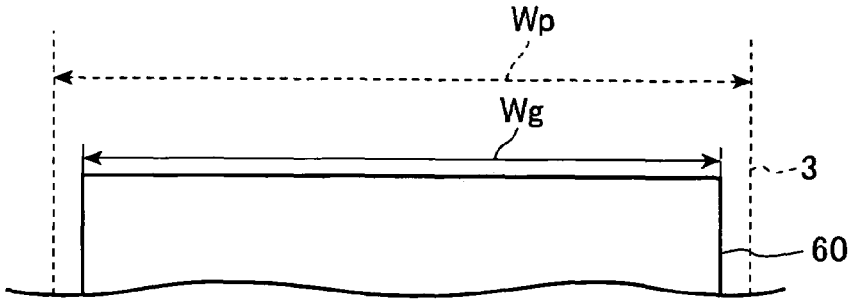
FIG. 4(*a*) is a plan view of the film member disposed at the lower casing shown in FIG. 3(*a*), where the film member is continuous in a widthwise direction.
Figure 4B:
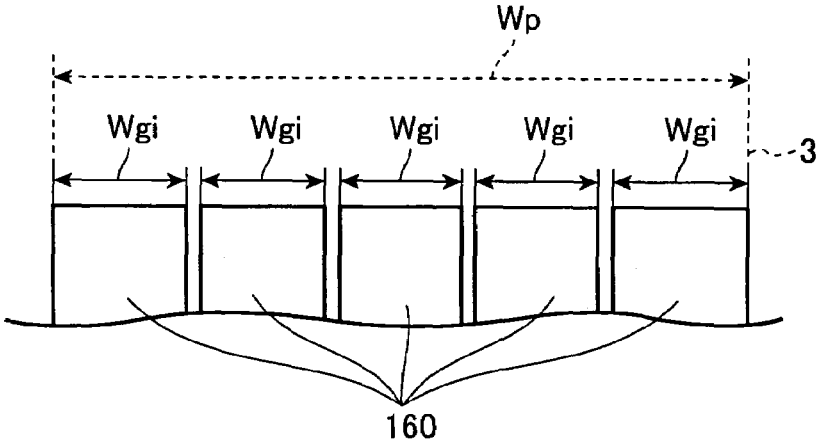
Figure 4C:
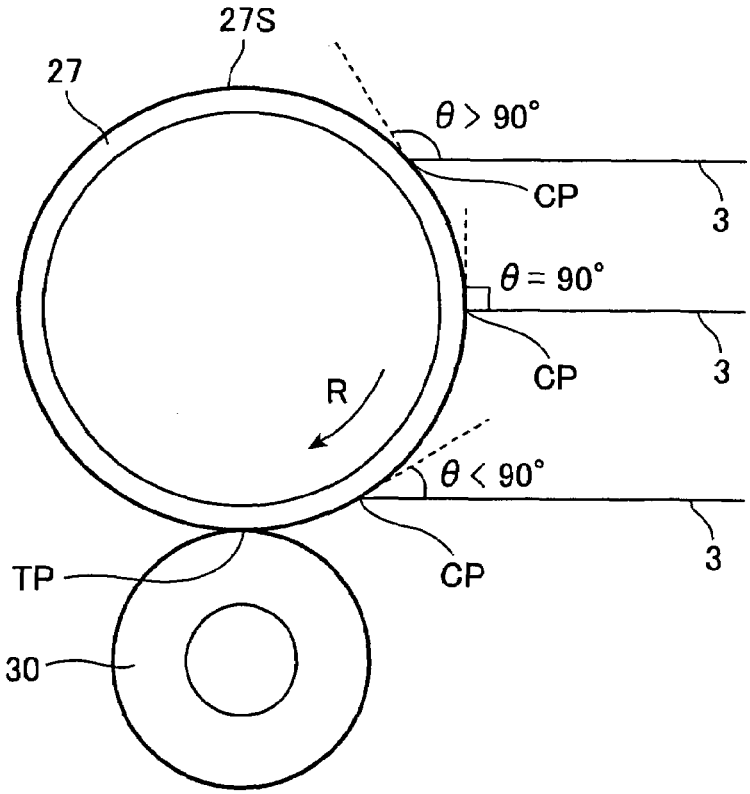

As shown in FIG. 4(*a*), the film member 60 has a width Wg in a direction substantially parallel to the axial direction of the photosensitive drum 27. The sheet 3 has a maximum width Wp in the axial direction. The maximum width Wp is a width of the widest sheet on which the laser printer 1 can form images. The maximum width Wp is predetermined by specifications of the process cartridge 17 and the laser printer 1. In the present embodiment, the width Wg and the maximum width Wp satisfy a relationship $$Wg \geqq Wp - 0.04(m) \quad (1).$$

That is, the width Wg is greater than or equal to the maximum width Wp minus 0.04 meter.

In the present embodiment, as shown in FIG. 4(*a*), the film member 60 is formed continuously in the widthwise direction. However, as shown in FIG. 4(*b*), film members 160 may be formed dividedly or in segmented fashion. The film members 160 are formed in parallel and separated at a predetermined interval in the widthwise direction. In this case as well, it is preferable that a sum total Wg of widths Wgi of the respective film members 160 satisfies the above relationship (1).

In this way, with the film member 60, a contact position at which a leading edge of the sheet 3 makes contact with the surface 27S of the photosensitive drum 27 can be set using the bend or flexibility of the front portion 63 of the film member 60. In other words, the contact position is determined depending on a flexibility of the front portion 63.

As shown in FIGS. 2 and 4(*c*), the photosensitive drum 27 is rotatable in its rotational direction R. The sheet 3 contacts the surface 27S of the photosensitive drum 27 at the contact position with a contact angle θ. The contact angle θ is formed between the sheet 3 and a tangent line extending from the contact position toward an upstream direction in the rotational direction R. In the present embodiment, the film member 60 is disposed to guide the sheet 3 such that the contact angle θ satisfies a condition $\theta<90°$.

Next, operations for guiding thin sheet 3 and thick sheet 3 to the transfer position TP in the process cartridge 17 will be described with reference to FIGS. 5 and 6.

Figure 5:
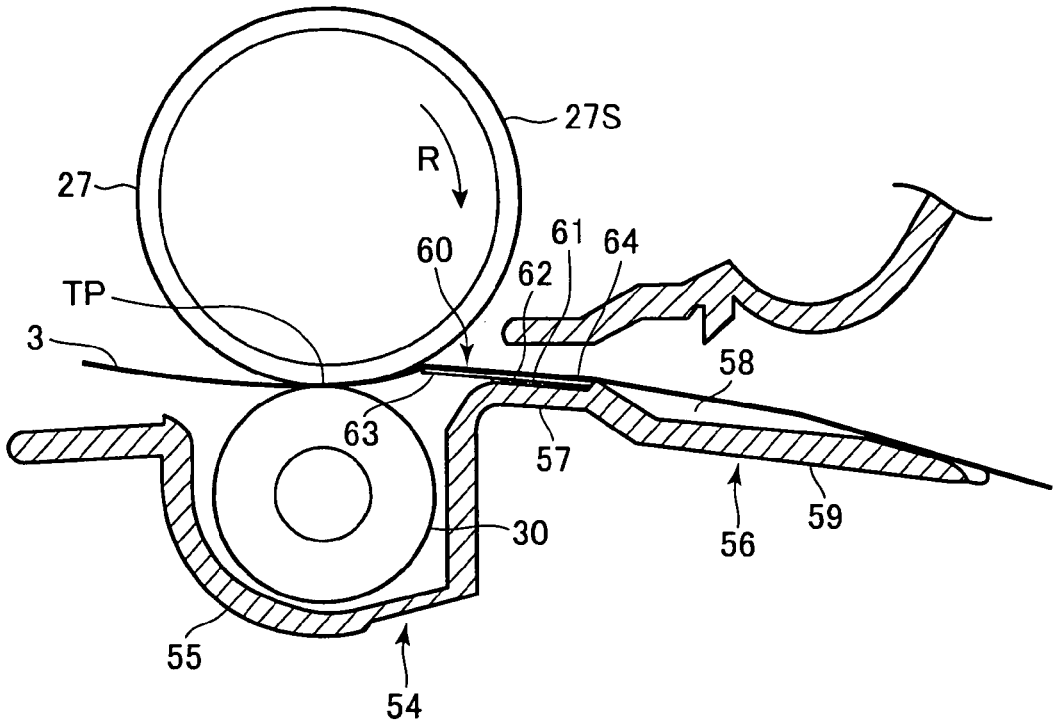
FIG. 5 is a side cross-sectional view of the lower casing shown in FIG. 3(*a*), in which thin sheet 3 is guided and conveyed.

FIG. 5 shows thin sheet 3 being guided to the transfer position TP. As shown in FIG. 5, when the thin sheet 3 is conveyed from the registration rollers 12, the leading edge of the sheet 3 first passes over the ribs 58 and progresses from the rear portion 64 to the front portion 63 of the film member 60. The leading edge of the sheet 3 is then guided so as to come into contact with a contact position on the surface 27S of the photosensitive drum 27 that is upstream from the transfer position TP in the rotational direction R.

However, because thin sheet 3 lacks firmness or has a small flexural rigidity compared with thick sheet, even after the leading edge of the thin sheet 3 comes into contact with the photosensitive drum 27, the front portion 63 of the film member 60 does not bend very much, and the thin sheet 3 can be guided to the transfer position TP as is, in close contact with the surface 27S of the photosensitive drum 27.

Accordingly, on the upstream side of the transfer position TP, a gap is not formed between the thin sheet 3 and the photosensitive drum 27. Hence, an occurrence of electrical discharges can be suppressed. As a result, the appearance of a speckled discharge pattern known as "pierce-through" which perforates the sheet 3 can be prevented via a simple construction which merely provides the film member 60.

Figure 6:
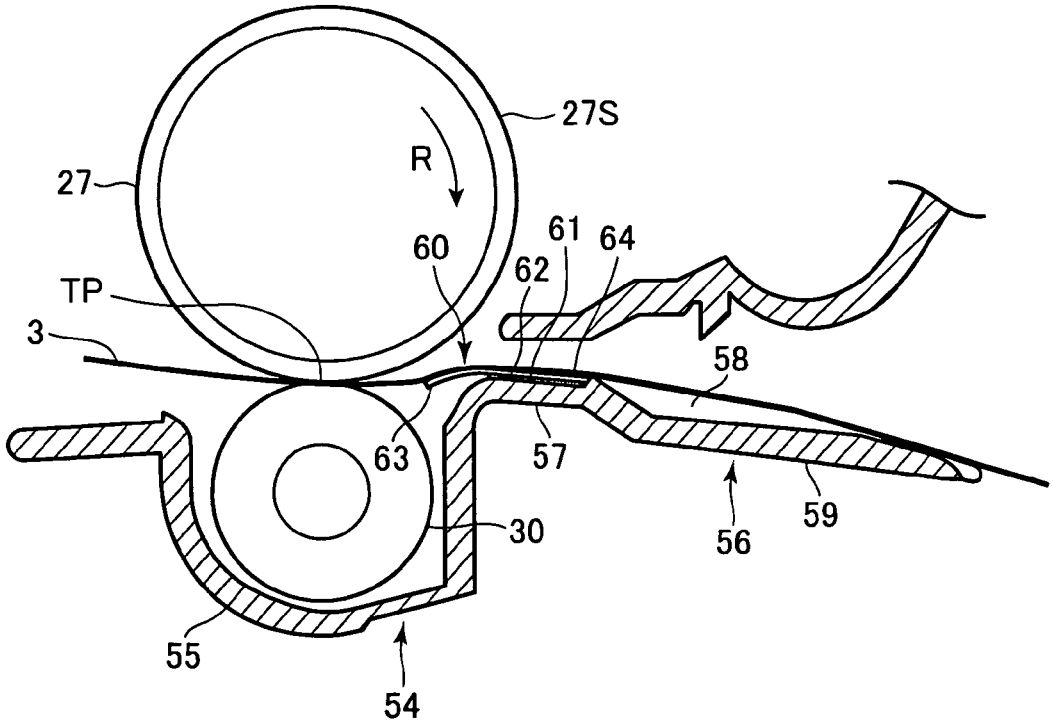
FIG. 6 is a side cross-sectional view of the lower casing shown in FIG. 3(*a*), in which thick sheet 3 is guided and conveyed.

FIG. 6 shows thick sheet 3 being guided to the transfer position TP. As shown in FIG. 6, for the process cartridge 17, when the thick sheet 3 is conveyed from the registration rollers 12, the leading edge of the sheet 3 first passes over the ribs 58 and progresses from the rear portion 64 to the front portion 63 of the film member 60, and is then guided so as to come into contact with a contact position on the surface 27S of the photosensitive drum 27 that is upstream from the transfer position TP in the rotational direction R.

However, because thick sheet 3 has firmness or has a great flexural rigidity, the front portion 63 of the film member 60 bends in response to the thick sheet 3 heading downward after coming into contact with the photosensitive drum 27. Hence, the film member 60 can guide the leading edge of the thick sheet 3 to the transfer position TP such that the sheet 3 does not fold.

Thus, satisfactory transfer can be ensured even with thick sheet 3. For example, when performing two-sided printing, upon printing the second side in a curled state after having printed the first side, it is possible to prevent the appearance of ghosts at the leading edge of the sheet 3 on which the second side has been printed via a simple structure by merely providing the film member 60.

In this way, the front portion 63 changes its position and orientation due to its flexibility when the sheet 3 is guided thereon. The position and orientation of the front portion 63 is dependent on a flexural rigidity of the sheet 3, such as a great flexural rigidity for the thick sheet 3 and a small flexural rigidity for the thin sheet 3.

More specifically, as shown in FIG. 3(*a*), when the film member 60 guides the sheet 3 having a flexural rigidity, the front portion 63 has a deflection d1 in a direction from the photosensitive drum 27 toward the transfer roller 30, and the deflection d is dependant on the flexural rigidity of the sheet 3.

For example, it is assumed that, when the film member 60 guides the thick sheet 3 having a flexural rigidity f1, the front portion 63 has a deflection d1 in a direction from the photosensitive drum 27 toward the transfer roller 30 (FIG. 6). In contrast, when the film member 60 guides the thin sheet 3 having a flexural rigidity f2 smaller than the flexural rigidity f1 (f1>f2), the front portion 63 has a deflection d2 smaller than the deflection d1 (d1>d2) (FIG. 5). As shown in FIG. 5, the deflection d2 may be very small and may be approximately zero (0), depending on the flexural rigidity f2.

In this manner, with the process cartridge 17, by utilizing the bending or flexibility of the front portion 63 of the film member 60, an appearance of a discharge pattern due to electrical discharges in the case of thin sheet 3, as well as the appearance of ghosts due to the folding of the leading edge in the case of thick sheet 3, can be reliably prevented. Furthermore, this can be accomplished at low cost since a special drive mechanism is not necessary.

With the process cartridge 17, since the rear portion 64 of the film member 60 is held in place by the fixed holding member 57 which constitutes part of the lower casing 54, the front portion 63 of the film member 60 can bend freely with the rear portion 64 reliably fixed in a stable position. Accordingly, the rear portion 64 of the film member 60 is held in place via a simple structure in comparison with a case in which a separate holding member is provided to hold the rear portion 64. Also, the film member 60 in the process cartridge 17 can guide the sheet 3 in a manner suitable for both the thin sheet 3 and the thick sheet 3. Thus, the thin sheet and thick sheet are both reliably guided via a simple construction.

With the film member 60 held by the holding member 57, the upper surface 60S of the film 60 is at or below the height of the higher portion 61H of the step portion 61 (FIG. 3(*a*)). Hence, the sheet 3 conveyed from the rib members 58 to the film member 60 is conveyed smoothly without becoming caught at the boundary between the higher portion 61H of the step portion 61 and the film member 60. Accordingly, the sheet 3 can be guided smoothly.

As shown in FIG. 3(*a*), with the lower casing 54, the front end 58F of the rib members 58 is disposed at a height which is approximately the same as the height of the higher portion 61H (the rear end) of the step portion 61. Hence, the sheet 3 conveyed to the step portion 61 is conveyed smoothly without becoming caught at the boundary between the rib members 58 and the step portion 61. Accordingly, the sheet 3 can be guided even more smoothly.

The film member 60 is formed into a predetermined shape by cutting by pressing process and has a front surface and a back surface opposite to the front surface. The front surface is defined as a surface that comes into contact with a cutting blade first during the pressing process. The film member 60 is disposed such that the front surface 60S contacts the sheet 3 when the sheet 3 is conveyed on the film member 60, and that the back surface confronts the step portion 61. Accordingly, the sheet 3 can be guided smoothly without becoming caught at the front edge 63A of the back surface of the film member 60.

Figure 7:
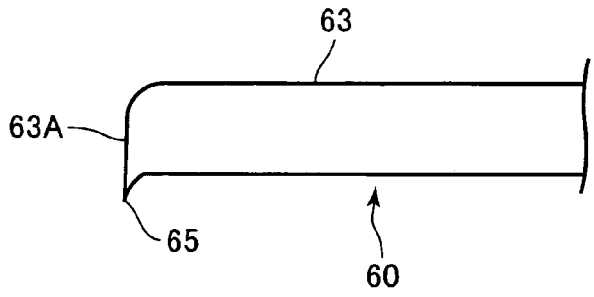
FIG. 7 is an enlarged side cross-sectional view showing an edge of the film member.

More specifically, as shown in FIG. 7, when the film member 60 is formed by pressing process, a tip 65 of the back surface is cut by a shearing force of a cutting blade and becomes prong-shaped (i.e. becomes a protrusion). If the back surface is then positioned as the upper surface which comes into contact with the sheet 3, then the sheet 3 will become caught on the prong-shaped tip 65 (protrusion), and smooth feeding cannot be achieved. However, in the present embodiment, the back surface does not come into contact with the sheet 3. Thus, the sheet 3 can be guided smoothly without becoming caught on the protrusion 65.

As described above, the film member 60 has a product EI satisfying a range $3.49\times10^{-5} \leqq EI \leqq 1.18\times10^{-3}$, where E is Young's modulus in the direction C parallel to the conveying direction, and I is the geometric moment of inertia with respect to the cross section S. In addition, the front portion 63 has the length N in the conveying direction that is greater than or equal to 1 mm. Accordingly, the film member 60 can provide a sufficient bending or flexure according to the thickness of the sheet 3, while being held by the holding member 57.

In addition, the front edge 63A of the front portion 63 of the film member 60 does not make contact with the photosensitive drum 27, and moreover is positioned above the line segment L which connects the transfer position TP between the photosensitive drum 27 and the transfer roller 30 with the registration position RP between the pair of registration rollers 12. Accordingly, frictional resistance due to contact between the photosensitive drum 27 and the front edge 63A, along with the wear and damage that this causes, can be prevented. In addition, the sheet 3 can be guided reliably toward the upstream side of the transfer position TP in the rotational direction R of the photosensitive drum 27, and a discharge pattern due to electrical discharges on thin sheet 3 can be reliably prevented.

As shown in FIG. 4(*c*), the contact angle θ is formed between the sheet 3 and the tangent line extending from the contact position CP toward an upstream direction in the rotational direction R. If the contact angle θ exceeds 90° (θ>90°), then the sheet 3 will be guided to the opposite side of the transfer position TP with regard to the contact position CP. If the contact angle θ is 90° (θ=90°), then, when the sheet 3 comes into contact with the surface 27S of the photosensitive drum 27, its leading edge will jam. However, the film member 60 is disposed in a position and orientation at which the film member 60 can guide the sheet 3 such that the contact angle θ is smaller than 90° (θ<90°). Accordingly, the sheet 3 can be guided smoothly toward the transfer position TP.

Since the film member 60 is formed of an insulating material such as a resin film, the conduction of electricity from the photosensitive drum 27 through the sheet 3 can be prevented. Accordingly, the developer image can be transferred reliably.

Also, since the film member 60 is configured such that its width Wg satisfies the relationship $$Wg \geqq Wp - 0.04(m) \quad (1)$$

with respect to the maximum width Wp of the sheet 3, the sheet 3 can be guided uniformly with regard to the widthwise direction. Accordingly, uniform transfer in the widthwise direction of the sheet 3 can be achieved.

As shown in FIG. 4(*b*) described above, if the film member 60 is formed dividedly in segments in the widthwise direction, then the frictional resistance at the film member 60 during paper feeding can be reduced, and the sheet 3 can be guided smoothly.

While the invention has been described in detail with reference to the specific embodiment thereof, it would be apparent to those skilled in the art that various changes and modifications may be made therein without departing from the spirit of the invention.

Figure 8:
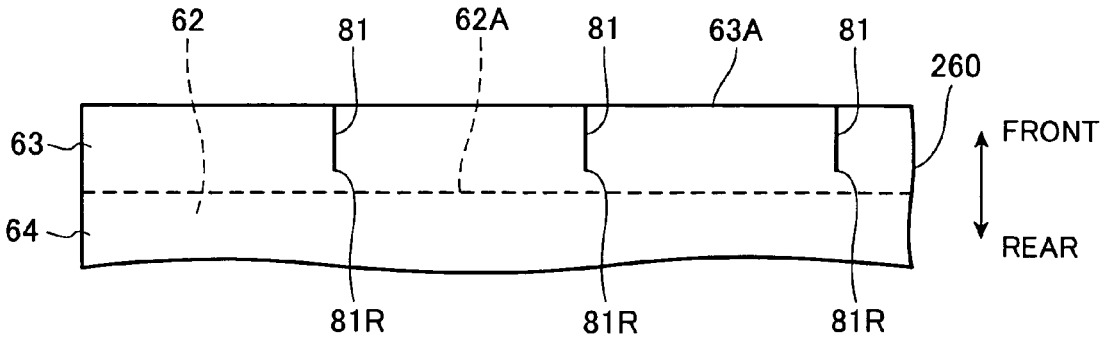
FIG. 8 is a plan view showing a film member formed with cut lines.

For example, in the above-described embodiment, the film member 60 (FIG. 4(*a*)) is formed continuously without any slit or cut line. FIG. 8 is a plan view of another film member 260. Along the front portion 63 of the film member 260, a plurality of cut lines 81 are formed in parallel at an approximately uniform spacing in the widthwise direction. Each of the cut lines 81 runs along the conveying direction of the sheet 3, starting from the front edge 63A of the front portion 63 of the film member 260 and extending partway to the rear portion 64. More specifically, each of the cut lines 81 extends from the front edge 63A toward the rear portion 64, up to a position 81R positioned at a predetermined distance from the front edge 62A of the double-sided tape 62.

By forming the cut lines 81 in this way, the film member 260 can be attached precisely with respect to the holding member 57 (FIG. 3(*a*)) without producing wrinkles in the film member 260.

Specifically, because the film member 60 in the above-described embodiment is thin (with a thickness of 80 to 200 μm) and is formed elongated in the widthwise direction, attaching or affixing the film member 60 by aligning its both widthwise edges with respect to the holding member 57 will result in the position of the widthwise center of the film member 60 being misaligned. Furthermore, by aligning one widthwise edge of the film member 60 with respect to the holding member 57, and then attaching the film member 60 progressively from the one widthwise edge to the other edge, the misalignment of the widthwise center of the film member 60 can be avoided, but this has a problem that wrinkles form readily on the film member 60. In this modification, since the cut lines 81 are formed, such wrinkles can be absorbed by the cut lines 81. Accordingly, the film member 260 can be attached precisely to the holding member 57 without producing wrinkles in the film member 260.

The front portion 63 of the film member 260 is segmented into a plurality of parts in the widthwise direction by the cut lines 81. Hence, during the feeding of sheet 3 which is narrow in the widthwise direction, the film member 60 can be bent at only the area which comes into contact with the sheet 3. Accordingly, in cases in which a large number of narrow sheets 3 is conveyed continuously, deformities to the entire film member 60 resulting from the bending of areas which come into contact with the narrow sheet 3 can be prevented. Thus, the durability and reliability of the film member 260 can be improved.

Figure 9A:
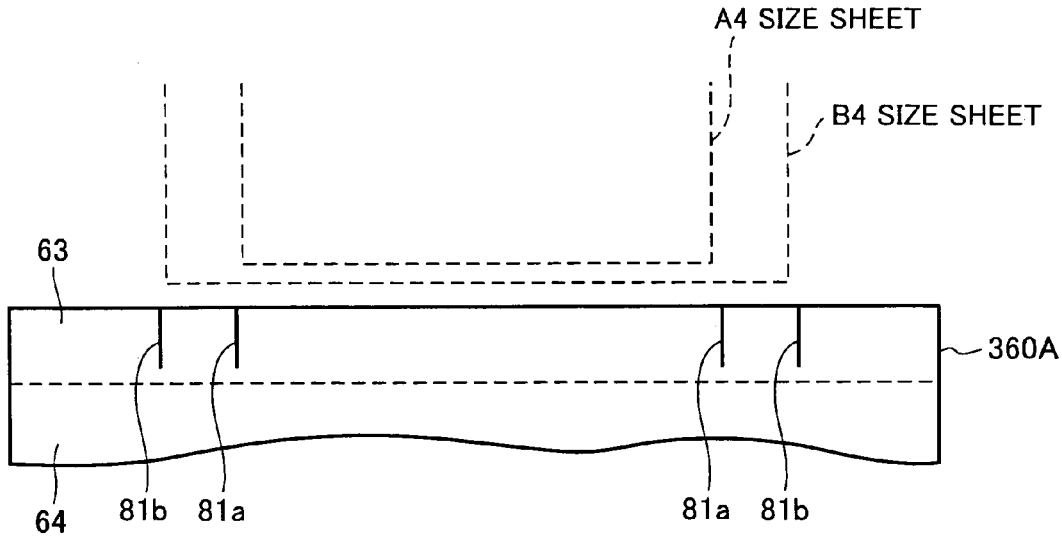
FIG. 9(*a*) is a plan view showing a film member formed with cut lines at positions in accordance with a plurality of paper sizes.
Figure 9B:
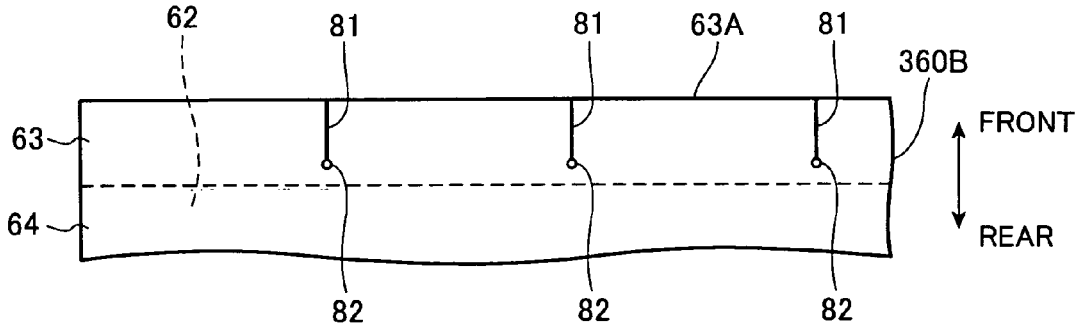
Figure 10A:
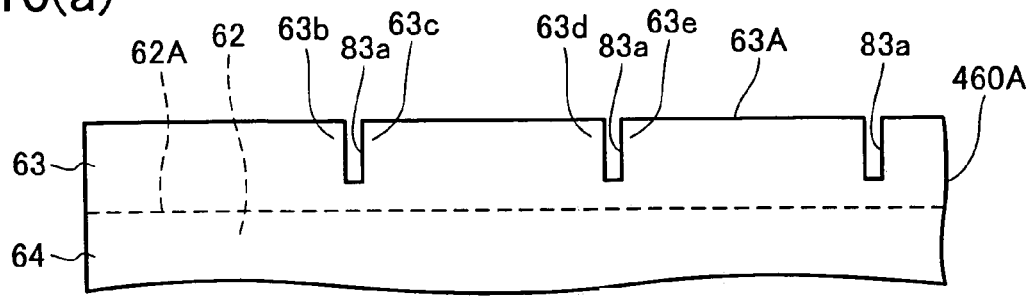
FIG. 10(*a*) is a plan view showing a film member formed with elongated cutouts having substantially rectangular shapes.
Figure 10B:
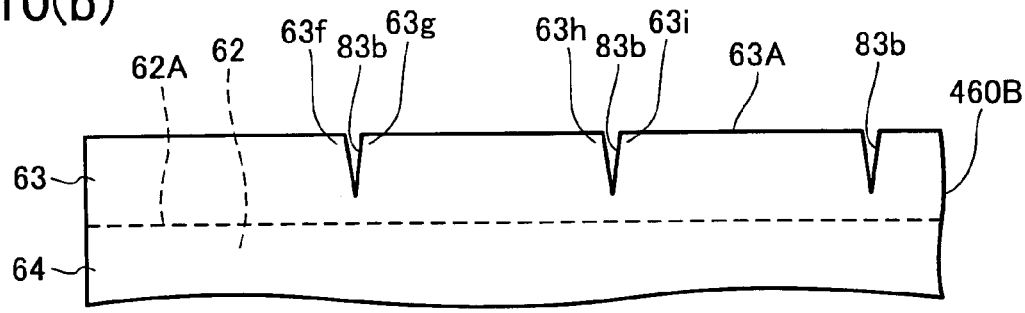
Figure 10C:
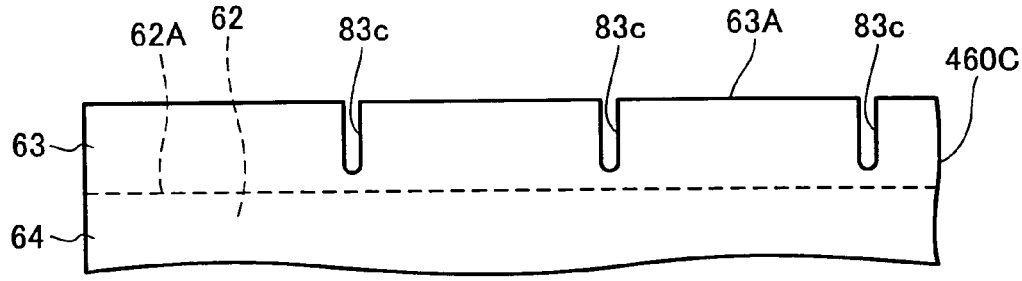
Figure 10D:
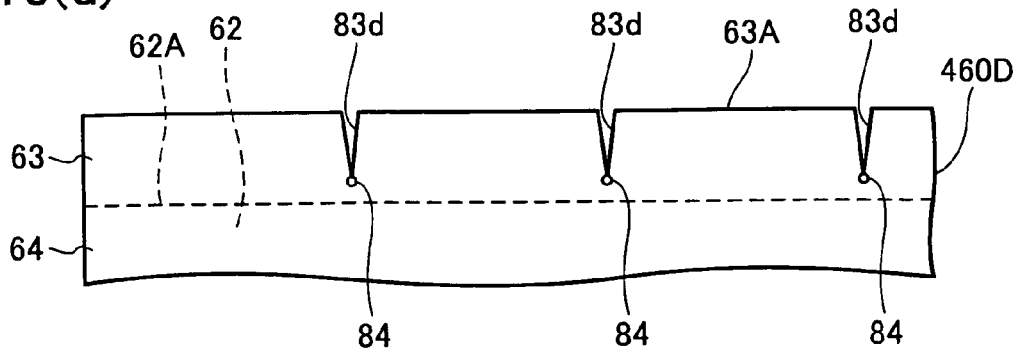

Alternatively, only a single cut line 81 may be formed in the front portion 63 of the film member 60. In addition, when the plurality of cut lines 81 are to be formed, it is not necessary that the cut lines 81 be formed such that their spacing is approximately uniform in the widthwise direction. The cut lines may be formed with intervals that vary from one another. For instance, as shown in FIG. 9(*a*), cut lines may be formed at respective locations in confrontation with the widthwise edges of the various sizes of sheet 3 in accordance with the various sizes of sheet 3 which can be used with the laser printer 1. In FIG. 9(*a*), a film member 360A is formed with cut lines 81*a* and 81*b* at positions in accordance with a plurality of sheet sizes, that is, ISO A4 and B4 sizes in this example. The pair of cut lines 81*a* corresponds to the A4 size sheet, and the pair of cut lines 81*b* corresponds to the B4 size sheet. In this modification, while the sheet 3 is being conveyed, the film member 360A can be bent more reliably in only the areas that come into contact with the sheet 3.

FIG. 9(*b*) is a plan view showing another film member 360B. Here, like parts and components are designated by the same reference numerals to avoid duplicating description. As shown in FIG. 9(*b*), on the film member 360B, tear prevention portions 82 are formed at the rear end of the cut lines 81 near the rear portion 64 (FIG. 2) The tear prevention portions 82 are formed at the ends of the respective cut lines 81 as openings or through-holes having substantially circular shapes. The tear prevention portions 82 penetrate the film member 360B from a top surface which comes into contact with the sheet 3 through to the opposite surface. Accordingly, tearing from the rear end of the cut lines 81 can be prevented.

FIGS. 10(*a*) to 10(*d*) are plan views of other film members 460A to 460D. As shown in FIGS. 10(*a*) to 10(*d*), along the front portion 63 of the film members 460A to 460D, on top surfaces which come into contact with the sheet 3, a plurality of elongated cutouts 83*a* to 83*d* are formed in parallel at a substantially uniform spacing in the widthwise direction. Each of the elongated cutouts 83*a* to 83*d* runs along the conveying direction, starting from the front edge 63A of the front portion 63 and extending partway to the rear portion 64 (FIG. 2). More specifically, each of the elongated cutouts 83*a* to 83*d* extends from the front edge 63A toward the rear portion 64, up to a location positioned at a predetermined distance from the front edge 62A of the double-sided tape 62.

In the same manner as when forming the cut lines 81, by forming the elongated cutouts 83*a* to 83*d*, the film members 460A to 460D can be attached precisely with respect to the holding member 57 (FIG. 3(*a*)) without producing wrinkles. Moreover, in cases in which a number of narrow sheets 3 is conveyed continuously, deformities to the entire film members 460A to 460D resulting from the bending of areas that come into contact with the sheets 3 can be prevented, and the durability and reliability of the film members 460A to 460D can be improved.

In addition, in contrast to the cut lines 81, since the elongated cutouts 83*a* to 83*d* have some breadth in the widthwise direction, it is possible to prevent portions adjacent to each other over each of the elongated cutouts 83*a* to 83*d* from overlapping each other when the film members 460A to 460D are attached to the holding member 57. For example, as shown in FIG. 10(*a*), portions 63*b* and 63*c*, and portions 63*d* and 63*e* are prevented from overlapping with each other.

As shown in FIG. 10(*a*), the elongated cutouts 83*a* are formed as a rectangular shape in surface-view. As shown in FIG. 10(*b*), the elongated cutouts 83*b* are formed as a V-shape. As shown in FIG. 10(*c*), the elongated cutouts 83*c* are formed as a U-shape.

As shown in FIGS. 10(*a*) and 10(*c*), if the elongated cutouts are formed as a rectangular shape or U-shape, then tearing from rear ends of the elongated cutouts 83*a* and 83*c* on the film members 460A and 460C can be prevented.

As shown in FIG. 10(*b*), if the elongated cutouts 83*b* are formed as a V-shape, there is separation between the areas sandwiching and confronting the elongated cutouts 83*b* in the film member 460C. Thus, it is possible to prevent portions adjacent to each other over each of the elongated cutouts 83*b* from overlapping each other when the film member 460B is attached to the holding member 57. For example, as shown in FIG. 10(*b*), portions 63*f* and 63*g*, and portions 63*h* and 63*i* are prevented from overlapping with each other.

In this case, as shown in FIG. 10(*d*), tear prevention portions 84 may be formed at rear ends of the elongated cutouts 83*d*. The tear prevention portions 84 are formed at the rear ends of the elongated cutouts 83*d* as openings or through-holes having substantially circular shapes. The tear prevention portions 84 penetrate the film member 460D from its top surface through to the opposite surface. By forming tear prevention portions 84, tearing from the deepest part or rearmost part of the elongated cutouts 83*d* can be prevented.

Alternatively, only a single elongated cutout may be formed in the front portion 63 of the film members 460A to 460D. In addition, when the plurality of elongated cutouts are to be formed, it is not necessary that the elongated cutouts be formed such that their spacing is approximately uniform in the widthwise direction. The elongated cutouts may be formed with intervals that vary from one another. For instance, cut lines may be formed at respective locations in confrontation with the widthwise edges of the various sizes of sheet 3 in accordance with the various sizes of sheet 3 which can be used with the laser printer 1. In this case, while the sheet 3 is being conveyed, the film members 460A to 460D can be bent more reliably in only the areas that come into contact with the sheet 3.

In the above-describe embodiment, the plurality of rib members 58 is provided at the sheet guide portion 56. However, only a single rib member 58 may be provided.

In the above-describe embodiment, the process cartridge 17 is detachably mounted on the laser printer 1. The photosensitive drum 27, the transfer roller 30, and the like are disposed in the process cartridge 17. However, the process cartridge 17 may be non-detachable from the laser printer 1.

COMPARATIVE EXAMPLE

Figure 11:
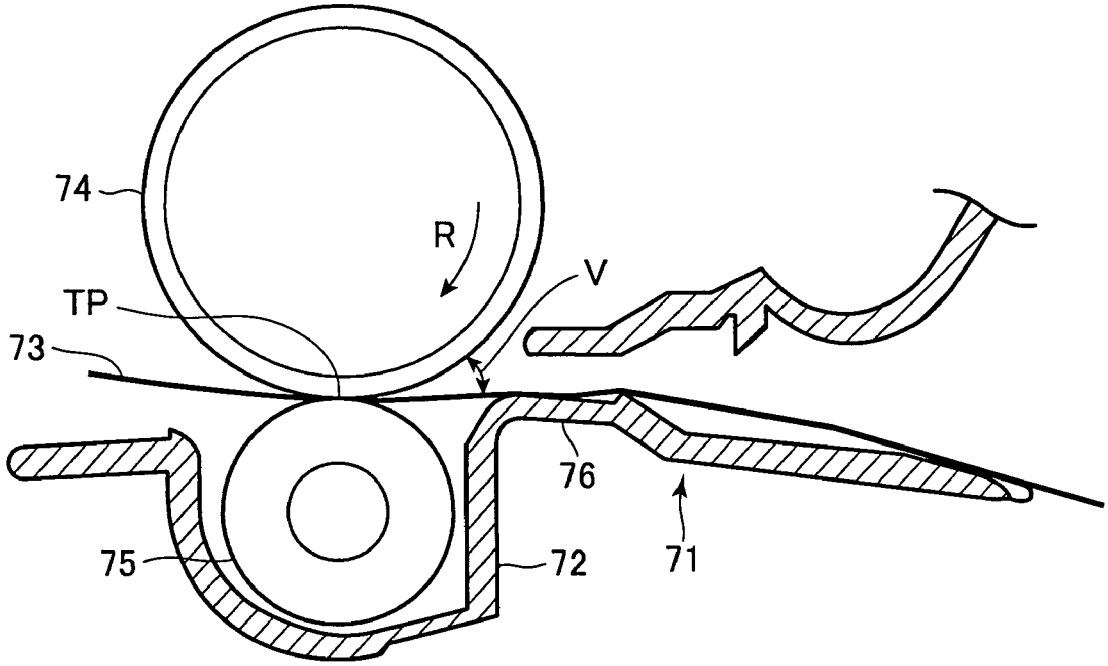
FIG. 11 is a side cross-sectional view showing part of a process cartridge according to a first comparative example.

In a comparative example shown in FIG. 11, a casing 72 of a process unit 71 is formed as a guide member 76 which extends upstream along the conveying direction of a sheet 73 between a photosensitive drum 74 and a transfer roller 75, such that the sheet 73 can be guided to a transfer position TP, which is the point of contact between the photosensitive drum 74 and the transfer roller 75.

However, since a gap V is formed, upstream of the transfer position TP, between the sheet 73 guided by the guide member 76 and the photosensitive drum 74, electrical discharges can arise therebetween. When the electrical discharges arise, especially with thin sheet 73, a speckled discharge pattern called "pierce-through" appears which perforates the sheet 73.

Figure 12:
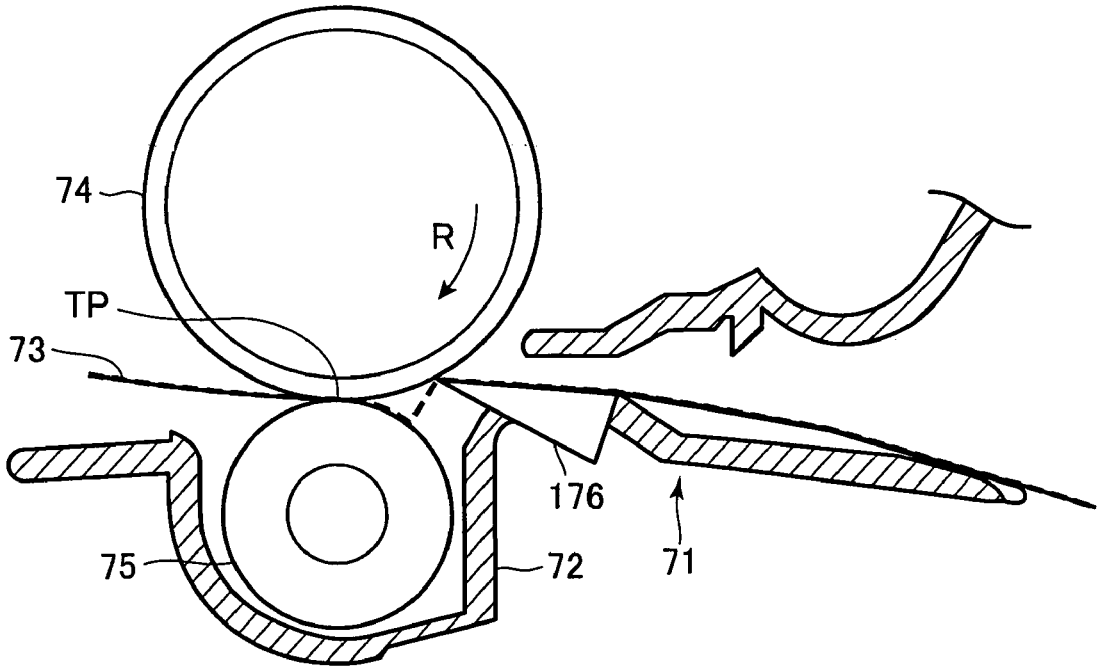
FIG. 12 is a side cross-sectional view showing part of a process cartridge according to a second comparative example.

To avoid this problem, as shown in FIG. 12, a guide member 176 is provided adjacent to the photosensitive drum 74, such that the leading edge of the sheet 73 is first brought into close contact with the upstream side of the transfer position TP in the rotational direction R, and then enters the transfer position TP between the photosensitive drum 74 and the transfer roller 75.

However, placing the guide member 176 adjacent to the photosensitive drum 74 would result in thin sheet 73 being guided well, but there are problems with thick sheet 73. For instance, when performing two-sided printing, upon printing the second side in a curled state after having printed the first side, abnormalities in feeding the leading edge of the sheet 73 occur more readily, poor transfer at the leading edge results, and the remaining portion of the transfer appears as a ghost after a full rotation of the photosensitive drum 74.

Compared with the comparative examples shown in FIGS. 11 and 12, the process cartridge 17 and the laser printer 1 of the above-described embodiment can reliably prevent an appearance of a discharge pattern due to electrical discharges in the case of thin sheet 3, as well as an appearance of ghosts due to the folding of the leading edge in the case of thick sheet 3, by utilizing the bending or flexibility of the film member 60. Furthermore, this can be accomplished by a simple construction to provide the film member 60.

What is claimed is:

1. An image forming device, comprising:

a casing;

an image bearing member having a surface on which a developer image is borne; and a guide member disposed upstream of the image bearing member in a conveying direction of a transfer medium, thereby guiding the transfer medium toward the image bearing member, the guide member including:

a front portion positioned adjacent to the image bearing member and being flexible; and a rear portion positioned upstream of the front portion in the conveying direction and being fixed at the casing, wherein only one surface of the transfer medium is guided by and in contact with the guide member when the transfer medium is conveyed toward the image bearing member.

2. The image forming device as claimed in claim 1, wherein the image bearing member extends in a lengthwise direction, and the front portion of the guide member has a widest surface on which the transfer medium is conveyed; and wherein the front portion has a product EI satisfying a range $3.49\times10^{-5}\leqq EI\leqq1.18\times10^{-3}$, where E is Young's modulus in a direction parallel to the conveying direction, and I a geometric moment of inertia with respect to a cross section that extends parallel to the lengthwise direction of the image bearing member and perpendicular to the widest surface of the front portion.

3. The image forming device as claimed in claim 1, wherein the image bearing member extends in an axial direction that is perpendicular to the conveying direction; and wherein the front portion of the guide member is divided into segments in a widthwise direction substantially parallel to the axial direction of the image bearing member.

4. The image forming device as claimed in claim 1, wherein the guide member includes a flexible member and a holding member holding the flexible member;

wherein the front portion of the flexible member has a front edge; and wherein the flexible member is formed with at least one cut line that starts from the front edge and, along the conveying direction, extends to a cut-end position partway to the rear portion.

5. The image forming device as claimed in claim 4, wherein the flexible member includes at least one tear prevention portion formed at the cut-end position of the at least one cut line, thereby preventing tearing of the flexible member from the cut-end position.

6. The image forming device as claimed in claim 4, wherein the front portion of the flexible member has a front edge; and wherein the flexible member is formed with at least one elongated cutout that starts from the front edge and, along the conveying direction, extends to a cut-end position partway to the rear portion.

7. The image forming device as claimed in claim 6, wherein the at least one elongated cutout has a substantially rectangular shape.

8. The image forming device as claimed in claim 6, wherein the at least one elongated cutout has a substantially V-shape.

9. The image forming device as claimed in claim 8, wherein the flexible member includes at least one tear prevention portion formed at the cut-end position of the at least one elongated cutout, thereby preventing tearing of the flexible member from the cut-end position.

10. The image forming device as claimed in claim 6, wherein the at least one elongated cutout has a substantially U-shape.

11. The image forming device as claimed in claim 1, further comprising a confronting member disposed in confrontation with the guide member with a space therebetween such that the confronting member does not contact the transfer medium that is conveyed toward the image bearing member.

12. The image forming device as claimed in claim 1, wherein the one surface of the transfer medium is a surface opposite to an image forming surface.

13. A process cartridge detachably mountable on an image forming device, comprising:

a casing;

an image bearing member having a surface on which a developer image is borne; and a guide member disposed upstream of the image bearing member in a conveying direction of a transfer medium, thereby guiding the transfer medium toward the image bearing member, the guide member including:

a front portion positioned adjacent to the image bearing member and being flexible; and a rear portion positioned upstream of the front portion in the conveying direction and being fixed at the casing, wherein only one surface of the transfer medium is guided by and in contact with the guide member when the transfer medium is conveyed toward the image bearing member.

14. The process cartridge as claimed in claim 13, wherein the front portion changes its position and orientation due to its flexibility when the transfer medium is guided thereon, the position and orientation of the front portion being dependent on a flexural rigidity of the transfer medium.

15. The process cartridge as claimed in claim 14, further comprising a transfer member disposed in confrontation with the image bearing member, wherein, when the guide member guides the transfer medium having a first flexural rigidity, the front portion has a first deflection in a direction from the image bearing member toward the transfer member; and wherein, when the guide member guides the transfer medium having a second flexural rigidity smaller than the first flexural rigidity, the front portion has a second deflection smaller than the first deflection.

16. The process cartridge as claimed in claim 15, further comprising a pair of registration members disposed upstream from the guide member in the conveying direction and in contact with each other at a registration position, wherein the image bearing member and the transfer member are in contact with each other at a transfer position; and wherein the front portion of the guide member has a front edge that is positioned on a side of the image bearing member with regard to a line segment connecting the registration position and the transfer position.

17. The process cartridge as claimed in claim 13, wherein the transfer medium has a leading edge that contacts the image bearing member at a contact position; and wherein the contact position is set using a flexibility of the front portion.

18. The process cartridge as claimed in claim 13, wherein the guide member includes:

a flexible member; and a holding member holding the flexible member and being fixed at the casing; and wherein the front portion of the guide member includes only the flexible member.

19. The process cartridge as claimed in claim 18, wherein the holding member constitutes part of the casing.

20. The process cartridge as claimed in claim 18, further comprising a transfer member disposed in confrontation with the image bearing member, wherein the image bearing member and the transfer member are rotatable to pinch and convey the transfer medium therebetween; and wherein the developer image is transferred onto the transfer medium when the transfer medium passes between the image bearing member and the transfer member.

21. The process cartridge as claimed in claim 20, further comprising a pair of registration members disposed upstream from the guide member in the conveying direction and in contact with each other at a registration position, wherein the image bearing member and the transfer member are in contact with each other at a transfer position; and wherein the front portion of the flexible member has a front edge that is positioned on a side of the image bearing member with regard to a line segment connecting the registration position and the transfer position.

22. The process cartridge as claimed in claim 21, wherein the front edge is positioned above the line segment connecting the registration position and the transfer position.

23. The process cartridge as claimed in claim 18, wherein the holding member is formed with a step portion for holding the rear portion of the flexible member, the step portion including:

a higher portion positioned at a first height; and a lower portion positioned at a second height lower than the first height;

wherein the rear portion of the flexible member has a top surface on which the transfer medium is conveyed; and wherein the top surface is positioned at a third height when the rear portion is held at the lower portion of the step portion, the third height being equal to or lower than the first height.

24. The process cartridge as claimed in claim 23, further comprising at least one rib member disposed upstream of the step portion in the conveying direction and having a downstream end in the conveying direction, the downstream end being positioned at a fourth height substantially equal to the first height.

25. The process cartridge as claimed in claim 18, wherein the image bearing member extends in a lengthwise direction, and the flexible member has a widest surface on which the transfer medium is conveyed; and wherein the flexible member has a product El satisfying a range $3.49\times10^{-5}\leqq EI\leqq1.18\times10^{-3}$, where E is Young's modulus in a direction parallel to the conveying direction, and I is a geometric moment of inertia with respect to a cross section that extends parallel to the lengthwise direction of the image bearing member and perpendicular to the widest surface of the flexible member.

26. The process cartridge as claimed in claim 18, wherein the flexible member is formed into a predetermined shape by cutting by pressing process and has a front surface and a back surface opposite to the front surface, the front surface being defined as a surface that comes into contact with a cutting blade first during the pressing process; and wherein the flexible member is disposed such that the front surface contacts the transfer medium when the transfer medium is conveyed on the flexible member, and that the back surface confronts a step portion.

27. The process cartridge as claimed in claim 18, wherein the flexible member is formed of insulating material.

28. The process cartridge as claimed in claim 18, wherein the image bearing member extends in an axial direction that is perpendicular to the conveying direction; and wherein the flexible member is divided into segments in a widthwise direction substantially parallel to the axial direction of the image bearing member.

29. The process cartridge as claimed in claim 18, wherein the front portion of the flexible member has a front edge; and wherein the flexible member is formed with at least one cut line that starts from the front edge and, along the conveying direction, extends to a cut-end position partway to the rear portion.

30. The process cartridge as claimed in claim 29, wherein the flexible member includes at least one tear prevention portion formed at the cut-end position of the at least one cut line, thereby preventing tearing of the flexible member from the cut-end position.

31. The process cartridge as claimed in claim 18, wherein the front portion of the flexible member has a front edge; and wherein the flexible member is formed with at least one elongated cutout that starts from the front edge and, along the conveying direction, extends to a cut-end position partway to the rear portion.

32. The process cartridge as claimed in claim 31, wherein the at least one elongated cutout has a substantially rectangular shape.

33. The process cartridge as claimed in claim 31, wherein the at least one elongated cutout has a substantially V-shape.

34. The process cartridge as claimed in claim 33, wherein the flexible member includes at least one tear prevention portion formed at the cut-end position of the at least one elongated cutout, thereby preventing tearing of the flexible member from the cut-end position.

35. The process cartridge as claimed in claim 31, wherein the at least one elongated cutout has a substantially U-shape.

36. The process cartridge as claimed in claim 13, wherein the image bearing member extends in an axial direction that is perpendicular to the conveying direction;

wherein the guide member has a width Wg in a direction substantially parallel to the axial direction of the image bearing member;

wherein the transfer medium has a maximum width Wp in the axial direction; and wherein the widths Wg and Wp satisfy a relationship $Wg\geqq Wp-0.04(m)$.

37. The process cartridge as claimed in claim 13, wherein the front portion of the guide member has a length, in the conveying direction, that is greater than or equal to 1mm.

38. The process cartridge as claimed in claim 13, wherein the front portion of the guide member has a front edge that is spaced from the image bearing member.

39. The process cartridge as claimed in claim 13, wherein the image bearing member is rotatable in a rotational direction;

wherein the transfer medium contacts the surface of the image bearing member at a contact position with a contact angle θ, the contact angle θ being formed between the transfer medium and a tangent line extending from the contact position toward an upstream direction in the rotational direction; and wherein the guide member is disposed such that the contact angle θ satisfies a condition $\theta<90°$.

40. The process cartridge as claimed in claim 13, further comprising a confronting member disposed in confrontation with the guide member with a space therebetween such that the confronting member does not contact the transfer medium that is conveyed toward the image bearing member.

41. The process cartridge as claimed in claim 13, wherein the one surface of the transfer medium is a surface opposite to an image forming surface.

42. An image forming devices, comprising:

a main casing;

a process cartridge detachably mounted on the main casing, including:

a casing:

an image bearing member having a surface on which a developer image is borne; and a guide member disposed upstream of the image bearing member in a conveying direction of a transfer medium, thereby guiding the transfer medium toward the image bearing member, the guide member having:

a front portion positioned adjacent to the image bearing member and being flexible; and a rear portion positioned upstream of the front portion in the conveying direction and being fixed at the casing, wherein only one surface of the transfer medium is guided by and in contact with the guide member when the transfer medium is conveyed toward the image bearing member; and a fixing unit fixing the developer image which has been transferred from the image bearing member to the transfer medium in the process cartridge.

43. The image forming device as claimed in claim 42, further comprising a confronting member disposed in confrontation with the guide member with a space therebetween such that the confronting member does not contact the transfer medium that is conveyed toward the image bearing member.

44. The image forming device as claimed in claim 42, wherein the one surface of the transfer medium is a surface opposite to an image forming surface.

* * * * *